United States Patent [19]

Martins

[11] Patent Number: 4,728,248

[45] Date of Patent: Mar. 1, 1988

[54] HUB-LIFTING AND ALIGNMENT APPARATUS

[76] Inventor: Mario F. Martins, 95 Tuckahoe Dr., Huntington, Conn. 06484

[21] Appl. No.: 12,433

[22] Filed: Feb. 9, 1987

[51] Int. Cl.[4] ..... B66C 23/00

[52] U.S. Cl. ..... 414/684; 414/910; 414/911

[58] Field of Search ..... 414/684, 428, 426, 27, 414/910, 911, 589; 242/58.6; 254/133 R

[56] References Cited

U.S. PATENT DOCUMENTS

| | | | |
|---|---|---|---|
| 2,551,483 | 5/1951 | Bartoe | 414/428 |
| 4,365,768 | 12/1982 | Woodruff | 414/911 X |
| 4,555,215 | 11/1985 | Raasch et al. | 414/911 X |
| 4,589,811 | 5/1986 | Riccardo et al. | 242/58.6 |

*Primary Examiner*—Frank E. Werner

*Assistant Examiner*—Donald W. Underwood

[57] ABSTRACT

An assembly for engaging the central bore of a narrow, standing heavyweight reel element, or the core thereof adjacent the opening of the bore, to facilitate the manual lifting and locking of such reel to an elevated shaft-alignment position for transfer of such reel onto a receptive horizontal shaft. The assembly comprises an elevated support member, a lever arm pivotally-attached thereto for vertical movement and including engagement means for locking the lever arm in raised position. The lever arm also has pivotally-attached thereto a depending swivel arm having a substantially-horizontal hub member for engaging the bore or core of the reel, supporting the reel in vertical position as the lever arm is raised and locked in shaft-alignment position and permitting the reel to be pushed onto the receptive shaft.

8 Claims, 4 Drawing Figures

HUB-LIFTING AND ALIGNMENT APPARATUS

BACKGROUND OF THE INVENTION

The present invention relates to a novel assembly for facilitating the manual lifting and attachment of a heavyweight reel, spool, wheel or other relatively-narrow wheel-like element, hereinafter referred to as a reel, having a central bore, a core or bearing provided with such a bore, said reel having a diameter substantially greater than its width. Most particularly, the present invention relates to an assembly for facilitating the frequent replacement of heavy, narrow rolls of wound paper on a high speed printing apparatus, manually by a single person. Such paper rolls generally have a diameter of from about two to three feet, a width of from 4 to 7½ inches and a weight of from 50 to 200 pounds.

The manual lifting of such heavyweight reels, particularly several times each day, is burdensome, physically dangerous and can be destructive to the paper roll if it is dropped or telescopes from its supporting core.

A variety of jacking devices, winches and other lifting devices are known for lifting wheels or reels onto supporting shafts. Reference is made to U.S. Pat. Nos. 475,021; 4,402,467 and 4,593,883 for their disclosures of such devices. Prior-known devices have several important disadvantages. Generally, they do not contain any means for locking them in predetermined raised position, or for aligning and facilitating the transfer of the reel to the receptive shaft, or for simple removal and out-of-the-way storage during periods of nonuse.

SUMMARY OF THE INVENTION

The novel assembly of the present invention comprises a lever arm pivotally-and, preferably, removably-attachable to a fixed upper support member for vertical lifting movement, cooperative means on the lever arm and on the support member for locking the lever arm in raised, shaft-aligned position, and a depending, balanced swivel arm pivotally-attached to the lever arm and having a hub support means which maintains an engaged reel substantially vertical during the vertical lifting movement of the lever arm.

The assembly is designed for use by a single person to facilitate the lifting, alignment and transfer of an upright, heavyweight reel having a central bore, such as a narrow roll of paper wound on a supporting core having a central bore, onto an elevated horizontal receiving shaft which is designed to support the roll during use. The upper support member of the assembly is attached in fixed position above and, preferably, at or inwardly of the base of the receiving shaft, secured to the frame of the receiving machine and/or to a floor-supported frame.

To use the present assembly, an individual merely rolls an on-end, heavyweight reel or wheel-like element along the floor into standing position, so that the bore thereof is adjacent to, below and in approximate vertical alignment with the receiving shaft. Then, the user attaches and/or pivots the lever arm down from the support member, guides the swivel arm to position the hub support means for engagement with or adjacent into the central bore of the reel, raises the lever arm to lift the engaged reel until the lever arm locks in raised position in which the assembly is self-supporting, and finally the individual merely pushes against the reel to slide it onto the receiving shaft with which the bore of the raised reel has been automatically aligned.

DISCUSSION OF THE DRAWINGS

DETAILED DESCRIPTION

Figure 1:
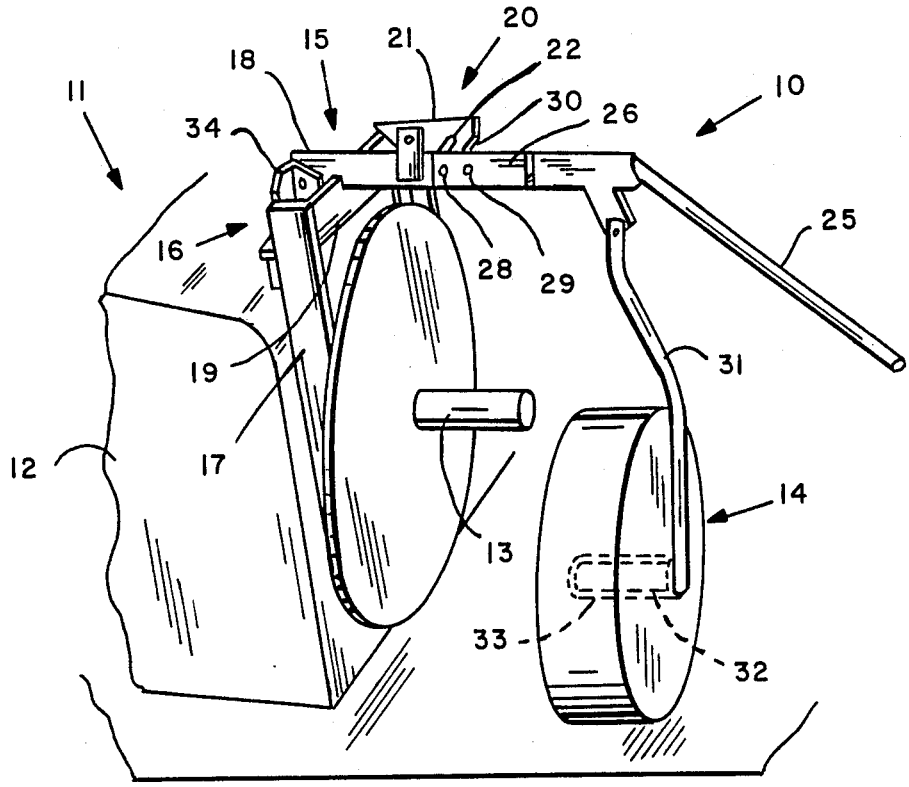
FIG. 1 is a perspective view of an assembly according to a preferred embodiment of the present invention, shown in association with a printing machine having a receptive shaft and a paper reel in position to be lifted.
Figure 2:
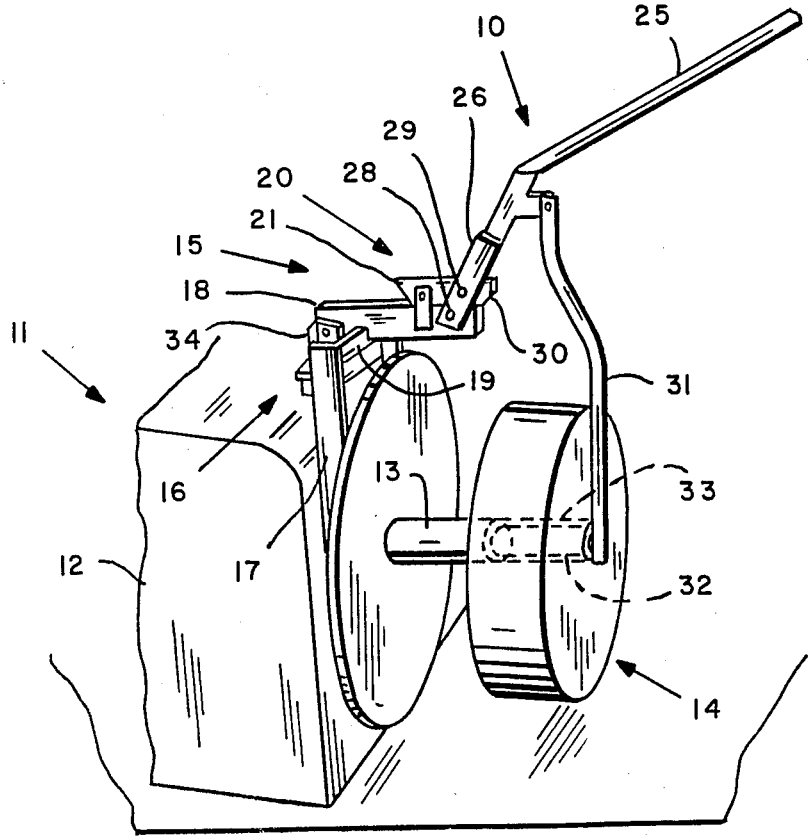
FIG. 2 is a perspective view similar to FIG. 1 but illustrating the assembly locked in raised position with the paper reel aligned for transfer onto the receiving shaft.

FIGS. 1 and 2 illustrate an assembly 10 according to the present invention in association with a printing machine, such as a Webtron machine, having an unwind stand 11 comprising a housing 12 supporting a horizontal receiving shaft 13 designed to hold a narrow paper reel 14 and to supply a continuous length of narrow paper under controlled tension to the printing mechanism (not shown). Shaft 13 has a bevelled end and is elevated above the floor by a distance slightly greater than the radius of the largest reel 14 designed to be mounted thereon. Depending upon the speed and length of operation of such a machine, several reels of paper may be consumed thereby each day, requiring frequent application of fresh paper rolls 14. The paper reel illustrated has a diameter of about 2 feet, a width of about 6½ inches and a weight of about 90 pounds.

The assembly of FIGS. 1 and 2 comprises a support member 15 which is secured to the housing 12 of the unwind stand 11 by a frame 16 having vertical attachment legs 17. Preferably, the upper support member 15, shown more clearly in FIG. 3, comprises a pivot arm 18 which is pivotally-attached to the center of horizontal cross member 19 of the frame 16, vertically aligned above the shaft 13, for movement between active position, shown in FIGS. 1 and 2, in which it extends horizontally in vertical alignment above the machine shaft 13, and passive position, shown in FIG. 4, in which it is rotated on the cross member 19 to a position in which it does not overlie the shaft or otherwise interfere with the operation of the machine, including the stand 11.

Figure 3:
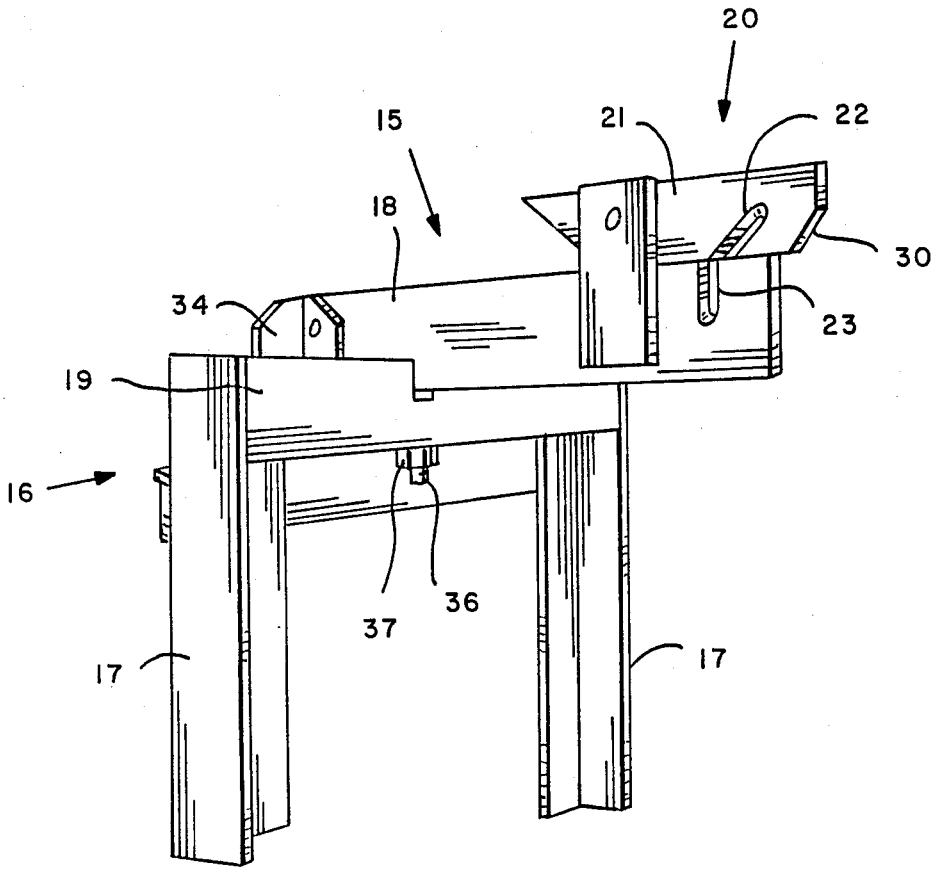
FIG. 3 is a perspective view of the support member of the assembly of FIGS. 1 and 2.

As illustrated by FIG. 3, the pivot arm 18 incorporates a locking member 20 comprising a movable latch 21 which is pivotally-connected to the arm 18 for vertical movement away from arm 18 and which includes an inwardly inclined downward slot 22 which is slightly offset ahead of an upward vertical slot 23 present on the arm 18. The slot 23 provides a releasable pivotal attachment point for the lever arm and the slot 22 provides a locking means for the lever arm in raised position, as will be discussed herein.

Figure 4:
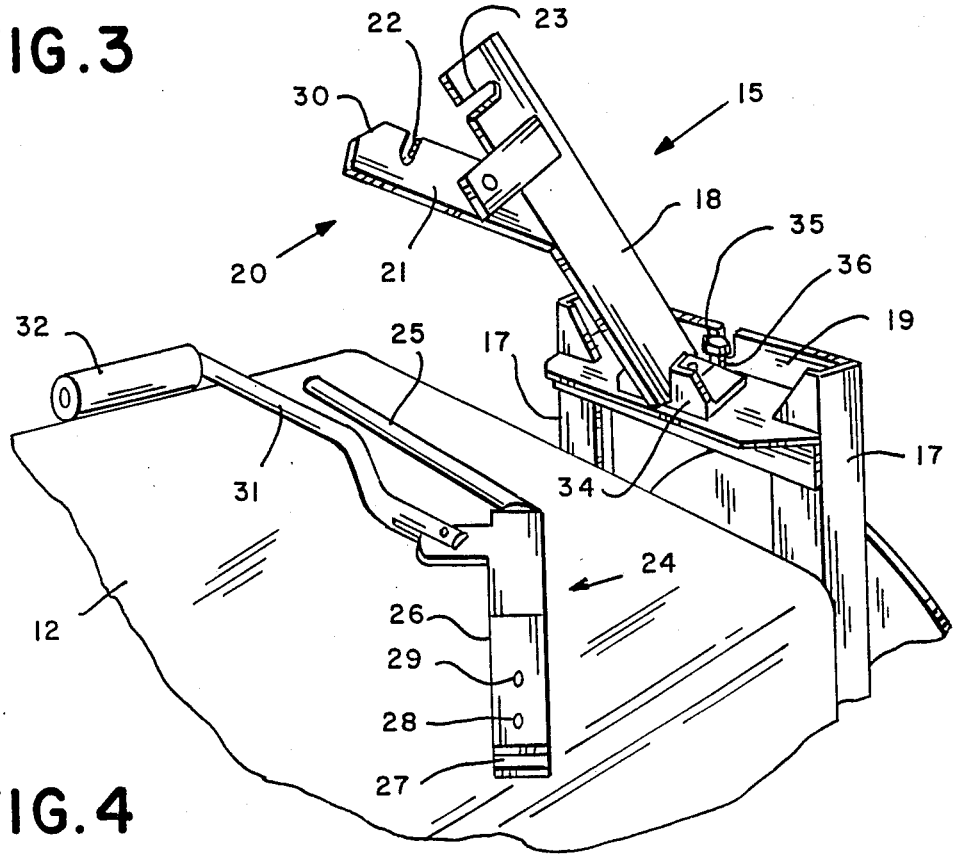
FIG. 4 is a perspective view of the lever arm of the assembly of FIGS. 1 and 2, detached from the support member, and the support member pivoted to passive position.

The lever arm 24, shown most clearly in FIG. 4, comprises an angular handle member 25 having an engagement section 26 which is designed to extend horizontally when member 24 is attached to the support arm 18 and is in lowered position. Section 26 comprises a forked end providing a vertical slot 27 containing transverse spaced pins 28 and 29. The lever arm is attached to the support arm 18 by pushing the forked end of the engagement section 26 and its notch 27 over the end and upper edge of arm 18 to cause the outermost pin 28 to lift the end of the latch 21, until pin 28 falls into the upward slot 23. This provides a strong pivotal attachment point for the lever arm 24, permitting vertical upward movement of the lever arm 24 to a predetermined elevated locking position in which the second or inward pin 29 is engaged by the downward slot 22 present on the latch 21. During upward movement of the arm 24, the cam surface 30 of the movable latch 21 is engaged by the inward pin 29 as the latch 21 moves into the slot 27. This pivots the latch 21 to open position (see FIG. 4) until the pin 29 enters the inclined downward slot 22. Slight downward movement of the lever arm 24 then causes the pin 29 to travel up the slot 22, against its inclination angle, and pull the latch down to horizontal locking engagement with the support arm 18.

The lever arm 24 also comprises an intermediate depending angular swivel arm 31 which is pivotally-attached to the engagement section 26 of the angular handle member 25, adjacent the bend or angle thereof, for vertical swivel movement along the plane thereof, i.e., towards and away from the machine shaft 13 when the lever arm 24 is attached to the support arm 18. The swivel arm 31 terminates in a perpendicular bore-engaging hub member 32, and arm 31 is designed to have a center of balance from its attachment point to lever arm 24 so that the hub member 32 extends outwardly and substantially horizontally toward the machine shaft 13 and in vertical alignment therewith at all positions of the lever arm 24 as the latter is raised and lowered during the lifting operation.

The pivotal attachment of the support member 15 to the horizontal cross member 19 of the frame 16 preferably is slightly adjustably in the vertical direction in order to provide slight height adjustments in the locking position of the assembly in raised position. Thus, as shown most clearly in FIGS. 3 and 4, the pivot arm 18 is attached to a pivot member 34 which is secured to cross member 19, and an adjustable stop member 35 comprising a vertical bolt 36 and lock nut 37 is positioned to engage the underside of the support arm 18 when the latter is pivoted to active position. This provides an adjustable setting for the height of the arm 18 and the locking member 20, in cases where the hub member of the reel may be irregular or slightly variable.

Referring to FIGS. 1 and 2, the lifting operation is carried out by an individual who rolls the reel 14, on end, into perpendicular alignment with the receiving shaft 13, as shown. The lever arm 24 is removed from stored position and the upper support arm 18 is pivoted from passive position into contact with stop member 35, both shown in FIG. 4, and the forked end of the lever arm 24 is slipped over the end of the narrow support arm to engage the pin 28 within the pivot slot 23, as discussed hereinbefore. Then the lever arm 24 and swivel arm 31 are manipulated to position and insert the hub member 32 completely into the central bore 33 of the reel 14 to be lifted, as shown in FIG. 1.

Next, the heavyweight reel is lifted into predetermined aligned, raised position by the application of lifting pressure to the handle 25 of the lever arm 24 to pivot the arm 24 on its support pin 28, causing locking pin 29 to engage the cam surface 30 of the latch 21, raise the latch 21 and permit pin 29 to enter the latch slot 22. At this point, the lifting pressure on handle 25 is released to permit the latch 21 to close down against support arm 18 and lock the lever arm 24 and engaged reel 14 in aligned position, shown in FIG. 2. In such position the outer end of the machine shaft 13 abuts against the outer end of the reel-supporting hub member 32 which most preferably is aligned slightly above the shaft 13 to provide a continuous sliding surface which facilitates the manual pushing of the reel 14 from the hub member 32 onto the shaft 13.

Finally, the lever arm 24 may be detached for storage until reuse is required, and the support arm 18 may be raised and pivoted to passive position, shown in FIG. 4. Detachment of arm 24 is accomplished by raising handle 25 slightly to cause the latch 21 to pivot open, holding latch 21 in open position with one hand and withdrawing the forked end of arm 24 and pins 28 and 29 from engagement with the support arm 18.

Since the depending swivel arm 31 is pivotally attached to the lever arm 24 at a position above the center of gravity of the reel 14 to be lifted, the hub member 32 and the reel 14 are maintained substantially vertical at all times during the lifting and locking procedure. Also, since such attachment position of arm 31 to arm 24 is slightly outward of the end of the machine shaft 13, the lifting operation moves the hub member 32 and reel 14 along an inclined upward, inward path so that the hub member 32 is firmly pressed against the end of the shaft 13 in aligned, locked, raised position.

As will be evident to one skilled in the art, the leverage provided by the present lever arm 24 enables an individual to lift heavyweight reels, including wheel-like elements of all types, such as cores carrying wound paper, plastic film, wire, sheet metal, vehicle wheels, grinding wheels, etc., while supporting such reels in vertical stability. The only requirement is that the element to be lifted onto a receiving shaft must have a horizontal bore, a reasonable weight and a width or thickness of less than about 15 inches, i.e., bore length. In the illustrated embodiment, the lifting assembly has a projecting hub member 32 which extends into the bore 33 of the reel to be lifted. However, the hub member 32 may be replaced with any hub support means for securement adjacent the central area of the reel to accomplish the same result. For example, some reels, such as grinding wheels, have a horizontal central bore having a radially nonuniform surface such as a conical surface. In such cases, the reel may be provided with attachment means, such as horizontal bolts or bolt holes, surrounding the central bore, and the projecting hub member 32 may be replaced with a hub support means comprising a vertical flange, such as a downward horseshoe flange provided with holes aligned with the bolts or holes in the reel to permit engagement by means of nuts or bolts for lifting purposes, as is conventional with vehicle wheels.

Depending upon the diameters of the shaft 13 and the bore 33 of the reels being lifted, it is possible to use a hollow or recessed-end hub support 32 so that the end of the shaft 13 extends into the hub support 32 a slight distance to provide an overlapping sliding surface to facilitate transfer of the reel onto the shaft. The shaft 13 is provided with means for locking the reel thereon or thereto.

The design of the pivot support structure of the present lifting assembly may be varied depending upon the structure of the shaft-supporting machine or apparatus with which it is to be used. The pivot support structure may be designed to be secured to the frame of the machine or apparatus, as illustrated, or it may be designed as a floor-engaging stand which is permanently or removably positioned at or behind the base of the receptive shaft to support the pivot arm 18 in vertical alignment above the receiving shaft by a distance greater than the radius of the reel to be attached to the shaft.

Variations and modifications of the present invention will be apparent to those skilled in the art within the scope of the present claims.

I claim:

1. An assembly, designed for use in association with an apparatus having an elevated horizontal receiving shaft, for facilitating the lifting, alignment and transfer of a heavyweight narrow reel having a shaft-engaging bore onto said shaft, said assembly comprising a pivot support means designed to be mounted in vertical alignment above the receiving shaft by a distance greater than the radius of the reel to be mounted thereon, an elongate lever arm having an attachment end, a handle end and an intermediate depending pivotally-attached swivel extension arm terminating in a hub support means, means for pivotally attaching the attachment end of said lever arm to said pivot support means in vertical alignment above the receiving shaft of an apparatus so that said swivel extension arm depends from said lever arm and said hub support means extends from said swivel extension arm in a horizontal direction towards said receiving shaft, manual lifting of the handle end of said lever arm causing said lever arm to pivot on said pivot support means and raise said swivel extension arm and its hub support means between horizontal lower position, in which the hub support means can be engaged adjacent the bore of a heavyweight narrow reel, and horizontal raised position in which the bore is in alignment with the receiving shaft, to permit manual transfer of the reel onto the receiving shaft, and means for locking said lever arm in raised position.

2. An assembly according to claim 1 in which said pivot support means comprises an extension arm, one end of which is attached for horizontal extension in vertical alignment above the receiving shaft, said extension arm having, adjacent the other end thereof, pivotal attachment means for the lever arm.

3. An assembly according to claim 2 in which said extension arm carries, adjacent said other end, a means for engaging the lever arm to lock it in raised position.

4. An assembly according to claim 3 in which said extension arm is a vertical flat plate having, adjacent said other end thereof, a transverse upward slot and supporting thereabove a pivotable latch means having a transverse downward slot, and the attachment end of said lever arm comprises a vertical slot containing spaced transverse outer and inner pins, the lever arm being attachable to the flat plate by inserting the plate within the said vertical slot and engaging the said outer pin within the said upward slot to provide pivotal attachment therebetween, the lever arm being lockable in raised position by pivoting it upward to cause the latch means to pivot open until the said inner pin of the lever arm engages the said downward slot of the latch means to provide a locking means.

5. An assembly according to claim 1 in which the depending swivel extension arm of the lever arm is shaped so that its point of pivotal attachment to the lever arm maintains a reel engaged by the hub support substantially vertical at all times during use.

6. An assembly according to claim 1 in which said hub support means comprises a projecting hub means which is receivable within the shaft-engaging bore.

7. An assembly according to claim 2 in which said assembly comprises a support frame, said extension arm is pivotally attached to the support frame, and the lever arm is removably attached to said extension arm so that the lever arm can be removed from the extension arm and the extension arm can be pivoted back over the support frame and out of position during periods of nonuse.

8. An assembly according to claim 2 in which said support frame comprises means for adjusting the height of the horizontal extension of said extension arm above said receiving shaft.

* * * * *